United States Patent [19]

Allen et al.

[11] 4,235,164

[45] Nov. 25, 1980

[54] APPARATUS FOR CRUSHING BEVERAGE CANS

[76] Inventors: A. Phil Allen, 180 W. Pebblewood La., Centerville, Utah 84014; Richard M. Hunsaker, 4668 Westview Dr., Salt Lake City, Utah 84117

[21] Appl. No.: 46,652

[22] Filed: Jun. 8, 1979

[51] Int. Cl.[3] ..... B30B 1/26; B30B 9/32

[52] U.S. Cl. ..... 100/53; 100/DIG. 2; 100/127; 100/244; 100/245; 100/257; 100/282; 100/295

[58] Field of Search ..... 100/DIG. 2, 295, 244, 100/264, 282, 257, 127, 53, 245

[56] References Cited

U.S. PATENT DOCUMENTS

| | | | |
|---|---|---|---|
| 2,773,536 | 12/1956 | Lange | 100/DIG. 2 |
| 3,048,096 | 8/1962 | Guedel | 100/244 |
| 3,079,856 | 3/1963 | Swartz | 100/DIG. 2 |
| 3,204,550 | 9/1965 | Swiderski | 100/245 |
| 3,580,167 | 5/1971 | Simshauser | 100/DIG. 2 |
| 3,608,478 | 9/1971 | Hoffman | 100/244 |
| 3,960,070 | 6/1976 | McClure | 100/DIG. 2 |

*Primary Examiner*—Billy J. Wilhite

[57] ABSTRACT

A beverage can compactor including an elongate compaction chamber for receiving emptied beverage cans. A pair of crushing platens are positioned for reciprocating movement from the opposite respective ends of the compaction chamber toward each other and then return to their initial positions at the respective ends of the compaction chamber. The compactor provides increased mechanical advantage at the beginning and end of the crushing stroke when such increased force is needed. Faster movement of the crushing platens is provided at the midpoint of the crushing stroke.

10 Claims, 5 Drawing Figures

APPARATUS FOR CRUSHING BEVERAGE CANS

BACKGROUND OF THE INVENTION

1. Field

The present invention involves apparatus for crushing beverage cans.

2. State of the Art

Numerous devices for crushing cans have been disclosed in the prior art utilizing ram screw drive for operating the crushing member or ram. Examples of such devices are shown in U.S. Pat. Nos. 3,079,856; 3,204,550; 3,580,167 and 3,960,070. Crushing and pressing devices which are designed for higher speed operation are disclosed in U.S. Pat. Nos. 3,048,096 and 3,608,478. The apparatus in both of the latter patents utilize a pair of plates which move together to crush or press an article placed between them. In U.S. Pat. No. 3,048,096, reciprocating motion is imparted to the plates by movement of eccentric wheels mounted at opposite ends of the device, with elaborate means for connecting the plates to races which are mounted on the respective wheels. The press of U.S. Pat. No. 3,608,478 utilizes pairs of press shoes which are operated with reciprocating motion imparted by crank arms attached to the respective shoes. The device is not designed to crush articles such as beverage cans but rather for high speed metal working applications. Distinct driving mechanisms are provided including separate crank arm systems located on opposite ends of the press chamber.

OBJECTIVES

The principal objective of the present invention is to provide compact, inexpensive apparatus for efficiently crushing metal beverage cans. A particular objective is to provide such apparatus which uses reciprocating crushing platens and wherein the drive and crank arm mechanism used in imparting reciprocating movement to the platens is compactly situated at one end of the can crushing chamber in which the platens reciprocate. Another objective is to provide a system wherein the mechanical advantage of the crank arm system used in driving the platens is such as to provide maximum force to the platens at the beginning and at the end of their crushing strokes while increased translational movement is imparted to the platens at the midpoint of their crushing strokes. A further objective is to provide control mechanism whereby the platens are returned to their initial position at the opposite ends, respectively, of the can crushing chamber at the end of each can crushing cycle. An additional objective is to provide apparatus having a safety interlock system which prevents operation of the platens when the cover for the can crushing chamber is not in its closed position, and which also provides means for quickly disengaging the motor and drive mechanism from the crank arms in emergencies.

SUMMARY OF THE INVENTION

The above objectives are achieved in accordance with the present invention by providing a beverage can compactor comprising an elongate, can-receiving compaction chamber having a pair of substantially flat, disk-like platens adapted for reciprocating movement from the respective ends of the compaction chamber toward the central portion of the chamber and then back to the respective ends of the chamber. Crank means are positioned adjacent one end of the compaction chamber for imparting the reciprocating, translational movement to the respective platens, so that the platens move from the opposite ends, respectively, of the chamber towards each other during one-half of the rotation of the crank means. During the remaining one-half of the rotation of the crank means, the platens move away from each other and back to their respective ends of the compaction chamber.

Additional objects and features of the invention will become apparent from the following detailed description of a preferred embodiment, taken together with the accompanying drawings.

THE DRAWINGS

A particular embodiment of the invention representing the best mode presently contemplated of carrying out the invention is illustrated in the accompanying drawings, in which.

DETAILED DESCRIPTION OF THE ILLUSTRATED EMBODIMENT

Figure 1:
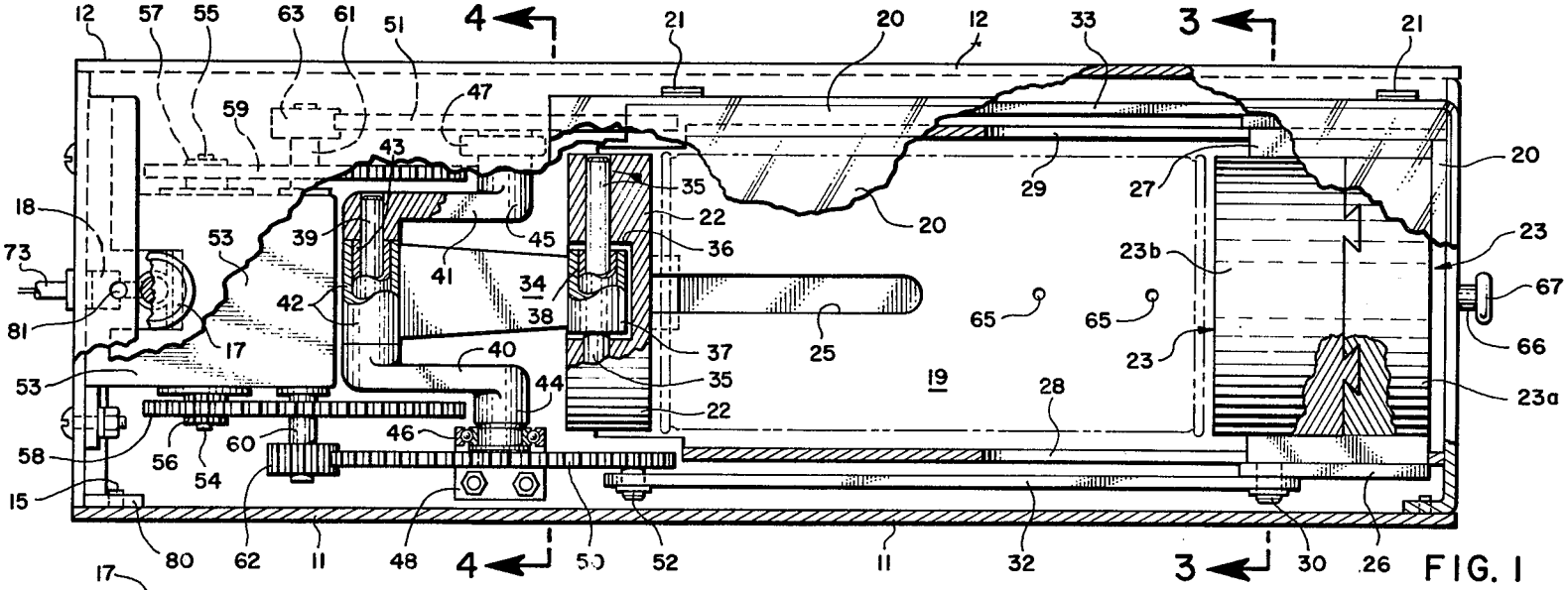
FIG. 1 is a top plan view of apparatus in accordance with the invention with portions of the top thereof being broken away to show internal parts.

Referring to the drawings, the can compacting and crushing device of the present invention includes a box-like housing having a bottom 10 and front and back side walls 11 and 12, respectively. The housing has end walls 13 and 14, respectively, with the end wall 14 being pivotally connected to the bottom of the housing for pivotal movement about pins 15 which are attached to the front and back walls 11 and 12, respectively. The top of the end wall 14 is releasably secured to the top 16 of the housing by a push catch 17 which is biased by spring 18 into latching relationship with the top portion of the end wall 14. As will be more fully described hereinafter, the catch 17 is released by pushing it downwardly against the spring 18 whereupon the side wall can be pivoted backwardly about the pins 15.

Figure 2:
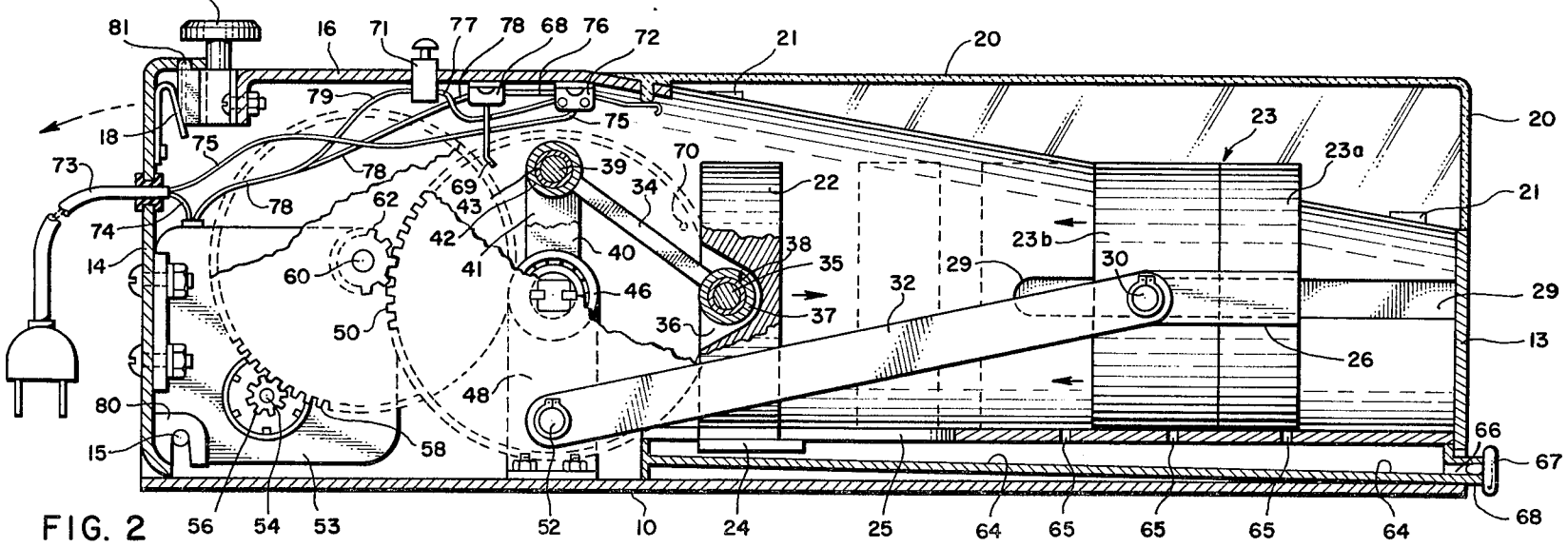
FIG. 2 is an illustrative longitudinal sectional view, showing the ends of the apparatus and the bottom of the can-receiving chamber in longitudinal section, with the motor, drive train, and platens in vertical elevation wherein portions of the drive train and one of the platens are broken away.
Figure 3:
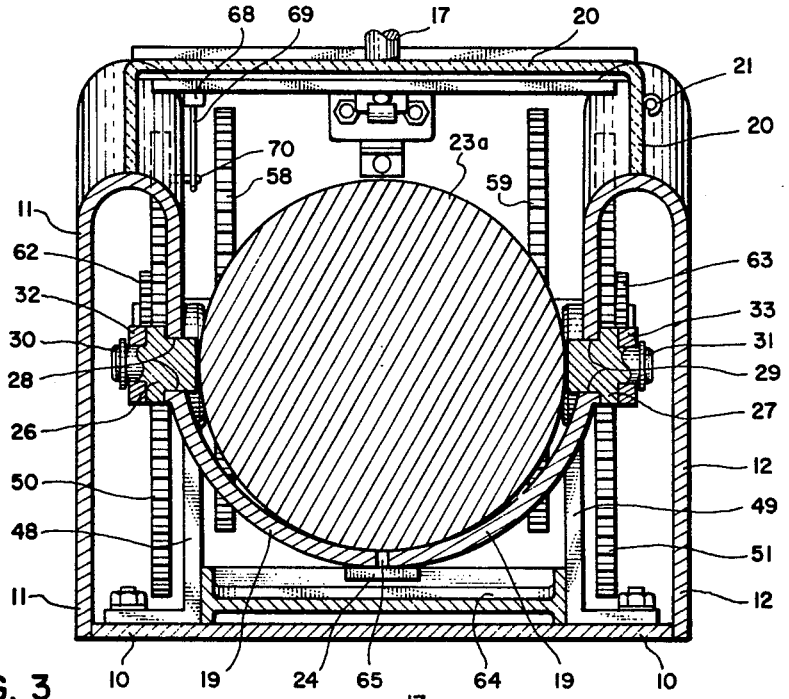
FIG. 3 is a transverse sectional view taken on line 3—3 of FIG. 1.

A compaction chamber is formed in the device by bending a portion of the front and back walls 11 and 12 inwardly and downwardly and then forming a generally cylindrically curved bottom 19 which is adapted to receive the beverage can. The rounded, curved portions of the front and back walls 11 and 12 slope downwardly as is best illustrated in FIGS. 2 and 3, and a cooperating cover 20 having a generally triangular longitudinal shape as shown in FIG. 2 is pivotally attached to the back wall 12 by hinges 21 (FIGS. 1 and 2). The cover 20 forms a protective, removable guard over the top of the compaction chamber, and, of course, when the cover 20 is open, access is provided to the compaction chamber.

A pair of platens 22 and 23 are positioned in the compaction chamber to move reciprocally back and forth therewithin. The first platen 22 is positioned adjacent one end of the compaction chamber, and is provided with a guide lug 24 protruding from the underside thereof into an elongate guide slot 25 in the curved bottom 19 of the compaction chamber. The guide slot 25 extends longitudinally inwardly from the end of the compaction chamber toward the midsection thereof, and the guide lug 24 is adapted to slide longitudinally back and forth along the guide slot 25. The second platen 23 is positioned adjacent the other end of the compaction chamber, and is provided with a pair of guide members 26 and 27, respectively, which extend outwardly in opposite directions from the respective sides of the second platen 23. The pins 26 and 27 are similar to the guide lug 24 on the first platen, in that they protrude from the side of the second platen 23 into elongate guide slots 28 and 29, respectively, in the sides of the compaction chamber. The guide slots 28 and 29 extend longitudinally inwardly along the opposite sides of the compaction chamber from the end thereof toward the longitudinal midsection thereof, and the guide members 26 and 27 are adapted to slide longitudinally back and forth along the respective guide slots 28 and 29. Preferably, the platen 23 is formed from two separable pieces **23*a* and 23*b*. The guide members 28 and 29 are then attached to the most remote portion 23*a* of the platen 23 and extend forwardly along the opposite sides of the other portion 23*b* of the platen 23. The section 23*b* of platen 23 is removable for purposes to be explained later. The section 23*a* has longitudinal undercut slots along its end facing the section 23*b*, and the section 23*b* has cooperating, longitudinal ridges along one of its ends, wherein the ridges are adapted for sliding engagement within the slots of section 23*a*. The section 23*b* is removably attached to section 23*a* by slidingly engaging the ridges thereon with the slots on section 23*a***.

Pivot pins 30 and 31 extend outwardly from the forward end of the guide members 26 and 27 in mutually opposite directions, respectively. A pair of push rods 32 and 33 are pivotally attached at mutually respective ends thereof to the respective pivot pins 30 and 31. The other ends of the push rods 32 and 33 are pivotally connected to crank arms at the sides of the one end of the compaction chamber, as will be more fully described hereinafter.

Figure 4:
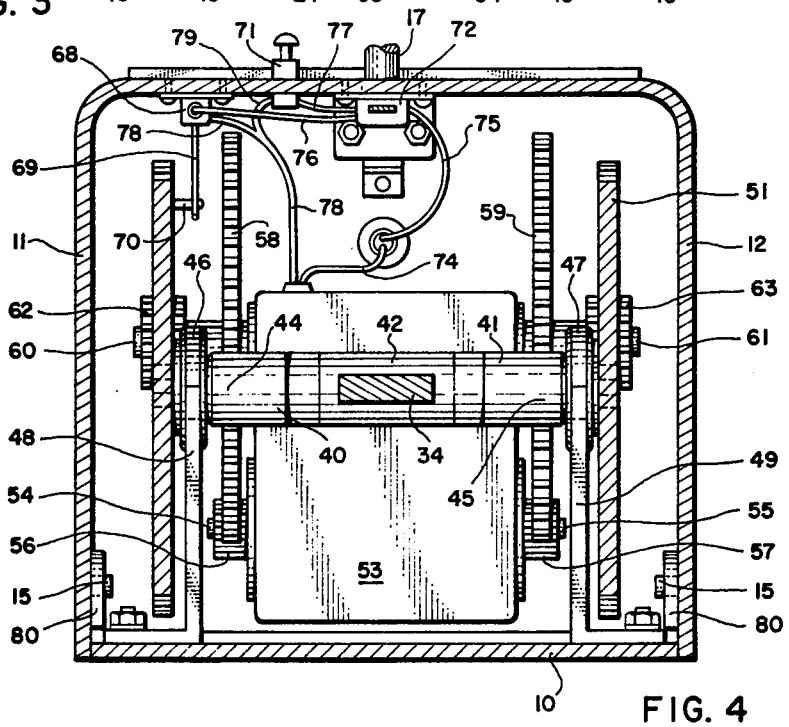
FIG. 4 is a transverse sectional view taken on line 4—4 of FIG. 1.

A push rod 34 is pivotally connected to platen 22 and extends to a crank arm positioned adjacent to the one end of the compaction chamber. As illustrated, the platen 22 has a pivot pin 35 (FIGS. 1 and 2) positioned longitudinally within a bore which extends diametrically from one side of the platen 22 to the other side. A central recess 36 is provided in the outer end face of platen 22 around the central portion of the pin 35. One end of the push rod 34 is adapted to be pivotally connected to the exposed central portion of pin 35. For that purpose a knuckle member 37 is attached to the end of arm 34. The knuckle member 37 has a central opening through which the pin 35 passes. A cylindrical bearing member 38 is positioned around the pin 35 and within the opening through the knuckle member 37, whereby the arm 34 and its knuckle member 37 can pivot about the pin 35. The other end of the push rod 34 is pivotally attached to a crank arm comprising a generally U-shaped member which is, as shown in FIG. 1, formed by an elongate rod 39 having two leg members 40 and 41, respectively, extending substantially perpendicularly from the ends of the rod 39 in the same plane as the rod 39. As shown, the ends of the leg members 40 and 41 which are attached to the rod 39 have openings therein which engage the respective ends of the rod 39. The portion of the rod 39 between the ends of the leg members 40 and 41 forms a pivotal pin about which the other end of the push rod is attached. For that purpose knuckle member 42 having a central opening therethrough is attached to the other end of the push rod 34, with the rod 39 passing through the opening in the knuckle 42. A cylindrical bearing member 43 is positioned around the rod 39 and within the opening through the knuckle member 37. Two coaxially aligned shafts 44 and 45 (FIGS. 1 and 4) extend outwardly, respectively, in mutually opposite directions from the otherwise free ends of the leg members 40 and 41. The shafts 44 and 45 are supported by bearings 46 and 47, respectively, for rotational movement of the U-shaped crank arm about the axis through the shafts 44 and 45. The bearings 46 and 47 are secured by bracket members 48 and 49, respectively, which extend upwardly from the bottom 10 of the device.

The shafts 44 and 45 extend through and beyond the bearings 46 and 47, respectively, and the crank arms associated with push rods 32 and 33 are connected to the respective ends of the shafts 44 and 45. As illustrated, the crank arms associated with push rods 32 and 33 comprise driven wheels 50 and 51 respectively, having gear teeth around the perimeters thereof. The geared wheels 50 and 51 are attached coaxially to the outwardly extending ends of the respective shafts 44 and 45. Each of the wheels 50 and 51 has a crank pin 52 spaced radially from the center of such wheel diametrically opposite from the point on the wheel which is intersected by the axis of the rod 39 of the U-shaped crank arm. The crank pins 52 extend substantially perpendicularly from the respective, outwardly facing sides of the wheels 50 and 51, and the ends of the push rods 32 and 33 are rotatably connected to the pins 52 on the respective wheels 50 and 51.

Means are provided for driving the geared wheels 50 and 51 which in turn drive the U-shaped crank arm. As shown, an electrical motor 53 and gear train are provided for this purpose. The motor 53 is positioned near the end 14 of the device and between the wheels 50 and 51. The motor 53 is of the type having drive shafts 54 and 55 extending from the respective sides thereof, and a pair of drive gears 56 and 57 are attached to the respective shafts 53 and 54. The drive gears 56 and 57 mesh with the larger gears 58 and 59, respectively, which rotate on pins 60 and 61. The pins 60 and 61 are mounted on the respective sides of the motor 53, extending substantially normally therefrom.

A pair of smaller gears 62 and 63 are attached coaxially to and are driven by the larger gears 58 and 59, respectively. The gears 62 and 63 mesh with the gear teeth on the perimeter of the wheels 50 and 51. The intermediate larger gears 58 and 59 and their smaller counterparts 62 and 63 result in a speed reducing gear train, such that the wheels 50 and 51 are driven at a rotational speed much less than the rotational speed of the motor 53. The particular sizing of the gears in the gear train will depend upon the motor speed and the desired cycle time, i.e., the time required for the wheels 50 and 51 to make one complete revolution. It has been found advantageous to provide gear reduction such that the can crushing cycle, i.e., the time for one complete revolution of the wheels 50 and 51, is from about one-half second to about 3 to 4 seconds.

As shown in FIG. 1, the device is in its initial position ready to initiate crushing of a can shown by dotted lines in the compaction chamber. The wheels 50 and 51 are positioned so that all the push rods are in a generally horizontal position parallel with the longitudinal axis of the compaction chamber. As the motor 53 is energized, the gear train drives the wheels in a clockwise direction as they are viewed in FIG. 2, and the platen 22 at the end of the compaction chamber nearest the motor 53 and gear train is pushed by rod 34 so as to move longitudinally inwardly towards the center of the compaction chamber. concurrently the platen 23 at the other end of the compaction chamber is pulled by rods 32 and 33 so as to move longitudinally inwardly towards the center of the compaction chamber. As the platens 22 and 23 move toward each other, the can in the compaction chamber is crushed. It has been found that common beverage cans made of aluminum can be crushed to a cylindrical disc having a thickness of about three-eighths inch.

In FIG. 2, the wheels 50 and 51 have been rotated about 90° or through the first quarter of the crushing cycle. As the wheels 50 and 51 rotate through another 90°, the maximum crushing motion is achieved, i.e., the platens 22 and 23 are at their closest positions. As the wheels 50 and 51 then complete the 360° rotation to their starting position, the platens 22 and 23 move away from each other to their initial positions adjacent to the respective ends of the compaction chamber.

As shown in FIGS. 1 and 2, the device is adapted to receive and crush conventional beverage cans of the size containing 12 ounces when they are filled. The device is readily adapted to receive and crush cans of the size containing 16 ounces. As was mentioned hereinbefore, the platen 23 is formed from two sections, with one section 23*a* being rigidly connected to the guide members 26 and 27 which are, in turn, pivotally connected to the push rods 32 and 33. But, section 23*b* of platen 23 can be removed simply be pulling it upwardly. When the section 23*b* has been removed, the compaction chamber can then receive a can of the 16 ounce size. When it is desired to crush cans of the 12 ounce size, the section 23*b* is simply slid back into engagement with section 23*a*.

In a preferred embodiment of the invention, the curved bottom 19 of the compaction chamber is spaced upwardly from the bottom wall 10 of the housing, and a drip pan 64 (FIGS. 2 and 3) is positioned between the bottom 19 of the compaction chamber and the bottom wall 10 of the housing. As best shown in FIG. 2, the drip pan slants downwardly in a direction from the end of the compaction chamber adjacent to the gear train to the end 13 of the housing. A plurality of drain openings 65 are provided in the bottom 19 of the compaction chamber so as to allow waste liquid from the beverage cans to drip into the drip pan 64. A drain opening 66 is provided in the end 13 of the housing, with the opening 66 being in flow communication with the drip pan 64. A plug 67 is advantageously placed in the opening 66 and is periodically removed to drain the build up of liquid from the drip pan 64.

The device is adapted to operate on a set cycle wherein the can to be crushed is placed in the compaction chamber, the motor 53 is energized, the platens 22 and 23 move toward each other to crush the can. The cycle is completed when the platens 22 and 23 return to their initial positions at the respective ends of the compaction chamber. Means are provided for automatically stopping the motor 53 at the end of each cycle of operation. The wheels 50 and 51 make one revolution per crushing cycle of the apparatus. As illustrated, an electrical switch 68 is associated with one of the wheels 50 and 51 for stopping the motor 53 at the end of the crushing cycle. The switch 68 is mounted to the top wall 16 of the housing and adjacent to the wheel 50. A switch lever 69 extends from the switch 68 alongside the upper side portion of wheel 51. An actuating pin 70 extends from the side of the wheel 51 so that as the wheel 51 rotates, the pin 70 contacts and deflects the switch lever 69 to turn the switch 68 off. The actuating pin 70 is positioned on the wheel 51 such that the pin 70 deflects the switch lever 69 at the end of the crushing cycle as the platens 22 and 23 return to their initial position at the opposite ends, respectively, of the compaction chamber.

Figure 5:
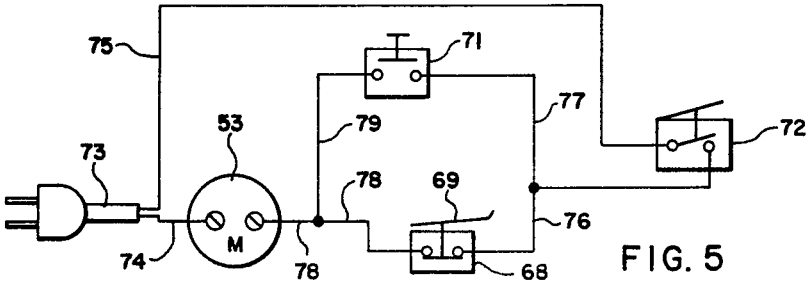
FIG. 5 is a schematic view of the electrical system of the apparatus of FIG. 1.

An electrical schematic of the switch system is shown in FIG. 5. The switch 68 is normally closed, but when actuator pin 70 deflects the switch lever 69, the switch opens and the motor 53 stops. Means must be provided, of course, to shunt the open switch 68 in initiating a new crushing cycle. By momentarily shunting the switch 68, the motor 68 starts and the wheel 51 moves sufficiently that latch 69 is no longer deflected. The switch 68 then closes and the shunting switch 71 can then be opened so that the motor 53 can once again be stopped by the opening of switch 68 at the end of the crushing cycle.

A safety switch 72 is also advantageously provided in combination with the cover 20 of the compaction chamber. When the cover 20 is open, the switch 70 is also open, and the motor 53 cannot be started. As shown in FIG. 5, the safety switch 72 is in series with the switch 68 and the shunting switch 71. Thus, even if the shunting switch is closed, the motor 53 will not run unless the safety switch 72 is also closed. As shown in the drawings, the line cord 73 enters the end 14 of the housing, and one line 74 (the electrical return line) is connected directly to the motor 53. The power line 75 is connected directly to the safety switch 72 associated with the cover 20 of the housing. The safety switch is wired to the cycle stopping switch 68 by line 76 and to the shunting switch 71 by line 77. The shunting switch 68 is a normally open, push button switch mounted in the cover 16 of the housing. The lines 78 and 79 from the switches 68 and 71, respectively are joined together and then connected to the motor 53.

As was mentioned hereinabove, the end 14 of the housing to which the motor 53 is attached is pivotally mounted to the bottom 10 of the housing. The end wall 14 has an inwardly curved bottom edge and a pair of hook members 80 attached at the opposite bottom corners, respectively, of the end wall 14. The hook members 80 hook over the pivot pins 15 which extend from the bottom corners of the front and back walls 11 and 12, respectively. The end wall 14 is normally held in its upright position by the push button catch 17. The catch 17 has a hook 81 which engages an opening in the upper edge of the end wall 14. The spring unit 18 biases the hook into normal engagement with the opening. If an emergency situation develops where it is desirable to quickly stop the crushing movement of the platens 22 and 23 and relieve the crushing pressure thereon, the push button on catch 17 can be pushed to release the end wall 14 so that it can pivot outwardly away from the housing. The motor 53 and gear train are supported by the end wall 14 and, thus, are disengaged from the wheels 50 and 51 when the end plate 14 is pivoted outwardly away from the housing. Disengaging the motor 53 and gear train from the wheels 50 and 51 immediately stops further movement of the platens 22 and 23 and relieves the crushing pressure thereon. When the cause of the emergency stoppage has been corrected, the end wall 14 is pivoted back into its normal position, and the motor 53 and gear system are once again engaged with the wheels 50 and 51 for further operation of the device. In addition to its use during emergency situations, the pivotal end wall 14 provides ready access to the inside of the housing for any repair work or maintenance to the working parts therein, including the motor 53 and gear system.

Whereas this invention is specifically illustrated and described with respect to an embodiment that represents the best mode presently contemplated of carrying out the invention, it should be understood that other embodiments and various modifications can be achieved in accordance with the teachings hereof without departing from the subject matter coming within the scope of the accompanying claims, which subject matter is regarded as the invention.

What is claimed is:

1. A beverage can compactor comprising:

an elongate, can-receiving, compaction chamber having a generally cylindrically curved bottom;

a pair of substantially flat, disk-like platens adapted for reciprocation movement from the respective ends of said compaction chamber toward the central portion of said compaction chamber and then back to the respective ends of said compaction chamber, a first rotating crank positioned adjacent one end of said compaction chamber for rotation about an axis normal to the longitudinal axis of said compaction chamber;

a first push rod connecting said first crank with one of the disk-like platens, so that as the first crank rotates, the push rod imparts reciprocating, translational motion to said one of the disk-like platens;

second and third rotating cranks positioned for rotational movements in spaced, parallel planes along the mutually opposite sides of said compaction chamber;

second and third push rods connecting the second and third cranks, respectively, to mutually opposite sides of the other disk-like platen, so that as the second and third cranks rotate, the push rods impart reciprocating, translational motion to said other disk-like platen; and means for rotating the second and third cranks in phase about their common axis and for rotating the first crank about said common axis but 180° out of phase with respect to the second and third cranks, whereby the pair of platens move from the opposite ends, respectively, of the compaction chamber towards each other during one-half cycle in the rotation of the first, second, and third cranks and then move away from each other back to their respective ends of the compaction chamber as the first, second, and third cranks complete the second half-cycle of the rotation.

2. A beverage can compactor in accordance with claim 1, wherein the second and third push rods are pivotally connected to respective pins which extend in mutually opposite directions from said other platens through respective elongate slots in the opposite sides of said compaction chamber, wherein said pins are guided in longitudinal movement along the elongate slots by the push rods.

3. A beverage can compactor in accordance with claim 2 wherein an elongate, guide slot is provided in the compaction chamber extending longitudinally inwardly toward the midsection of said compaction chamber from the end of said compaction chamber adjacent to the first crank, and said one platen has a guide member extending therefrom which is adapted to move longitudinally back and forth along said guide slot.

4. A beverage can compactor in accordance with claim 3, wherein said first crank comprises a generally U-shaped member including an elongate rod and two leg members extending from the ends of the rod, respectively, substantially normal to said rod and in the same plane as said rod, two coaxially aligned shafts extending outwardly in mutually opposite directions from the otherwise free ends of the leg members, respectively, and bearing means for supporting said shafts so that the U-shaped member can rotate about the axis of the shafts, with said first push rod being rotatably connected at one of its ends to the elongate rod of said U-shaped member and pivotally connected at its other end to said one platen; said second and third cranks comprise driven wheels attached coaxially to the outwardly extending ends of the respective shafts which extend from said U-shaped member, each of said wheels having a crank pin spaced radially from the center of such wheel diametrically opposite from the point on said wheel intersected by the axis of the rod of said U-shaped member and extending substantially perpendicularly from the outwardly facing side of such wheel, with the second and third push rods being rotatably connected at one of their mutually respective ends to the respective crank pins and pivotally connected at their other mutually respective ends to the mutually opposite sides of said other platen, and means are provided for driving said wheels in rotation about the axis through the centers thereof, whereby the driven wheels, in turn, drive the U-shaped member in rotation about the axis through said shafts to which the wheels are coaxially attached.

5. A beverage can compactor in accordance with claim 4, wherein said wheels are provided with gear teeth around the perimeter thereof and the means for driving the wheels comprises a motor and gear system which intermeshes with at least the gear teeth on one of said wheels.

6. A beverage can compactor in accordance with claim 5, wherein said motor is provided with a pair of matched gear systems, with one gear system intermeshing with the gear teeth on one of the wheels and the other gear system intermeshing with the gear teeth on the other wheel.

7. A beverage can compactor in accordance with claim 5 wherein the motor is electrically driven and means are provided for automatically stopping the motor at the end of each revolution of said wheels and U-shaped member, so that the crushing cycle of the platens is synchronized with the revolution of said wheels and U-shaped member, whereby the platens return to their positions at the opposite ends, respectively, of the compaction chamber, at the end of each such revolution or crushing cycle, and means are provided for energizing the motor to initiate a subsequent revolution or crushing cycle.

8. A beverage can compactor in accordance with claim 7, whereby the means for stopping the motor at the end of each crushing cycle comprises a switch activated by actuator means positioned on one of said wheels, such that the switch opens when the actuator is in proximity of said switch, and the means for energizing the motor to initiate a subsequent crushing cycle comprises a shunt circuit around said switch containing a second switch which can be momentarily closed at the beginning of each crushing cycle.

9. A beverage can compactor in accordance with claim 7 wherein a cover is provided for the compaction chamber and an override switch is provided in combination with said cover which prevents energizing said motor when said cover is open.

10. A beverage can compactor in accordance with claim 5, wherein a housing is provided for the apparatus including an end wall and bottom, with the end wall being pivotally attached to the bottom of the housing, said motor and gear system are mounted on and supported from the pivotable end wall of said housing, and means are provided for quickly releasing the pivotable end housing for pivotal movement whereby said motor and gear system are simultaneously disengaged from the gear teeth on said wheels.

* * * * *